US006244489B1

(12) United States Patent
Laurie

(10) Patent No.: US 6,244,489 B1
(45) Date of Patent: Jun. 12, 2001

(54) RETRACTABLE STAPLE REMOVER JAWS UTILIZING STAPLER MACHINE AS LEVER HANDLES

(76) Inventor: Robert Laurie, 412 Coolidge Dr., Kenilworth, NJ (US) 07033

( * ) Notice: Subject to any disclaimer, the term of this patent is extended or adjusted under 35 U.S.C. 154(b) by 0 days.

(21) Appl. No.: 09/414,140

(22) Filed: Oct. 7, 1999

Related U.S. Application Data

(60) Provisional application No. 60/111,970, filed on Dec. 11, 1998.

(51) Int. Cl.[7] ..... B25C 11/00
(52) U.S. Cl. ..... 227/63; 227/134
(58) Field of Search ..... 227/63, 76, 120; 254/134, 128, 121, 28; 7/160

(56) References Cited

U.S. PATENT DOCUMENTS

| | | | | |
|---|---|---|---|---|
| 2,059,021 | * | 10/1936 | Pankonin | 227/121 |
| 2,102,087 | * | 12/1937 | Pankonin | 227/63 |
| 2,227,314 | * | 12/1940 | Maynard | 227/120 |
| 2,233,958 | * | 3/1941 | Obstfeld et al. | 227/63 |
| 2,499,432 | * | 3/1950 | Von Cseh | 227/63 |
| 2,539,171 | * | 1/1951 | Yerkes | 254/28 |
| 3,563,513 | * | 2/1971 | Rubin | 227/63 |
| 3,672,635 | | 6/1972 | Munson et al. . | |
| 3,951,325 | * | 4/1976 | Mitsuhashi | 227/76 |
| 3,974,999 | | 8/1976 | Bertolet . | |
| 4,054,263 | | 10/1977 | Delia . | |
| 4,074,597 | | 2/1978 | Jansson . | |
| 4,114,793 | * | 9/1978 | Hsu | 227/63 |
| 4,674,727 | | 6/1987 | McAlister . | |
| 4,727,610 | * | 3/1988 | Lin | 227/76 |
| 4,783,867 | * | 11/1988 | Tsao | 7/160 |
| 4,784,370 | | 11/1988 | Strickland . | |
| 4,903,945 | | 2/1990 | Wang . | |
| 4,921,216 | | 5/1990 | Krulich . | |
| 4,944,491 | | 7/1990 | Kirk . | |
| 5,085,404 | | 2/1992 | Thieleke et al. . | |
| 5,183,196 | * | 2/1993 | Miyashita | 227/63 |
| 5,184,765 | | 2/1993 | Orozco . | |
| 5,284,322 | | 2/1994 | Clark . | |
| 5,292,106 | | 3/1994 | LI . | |
| 5,354,033 | | 10/1994 | Cheldin . | |
| 5,522,289 | | 6/1996 | Eggert . | |
| 5,904,078 | | 5/1999 | Gustafson et al. . | |
| 6,000,303 | | 12/1999 | Chang . | |

FOREIGN PATENT DOCUMENTS

| | | | | |
|---|---|---|---|---|
| 1019275 | * | 11/1957 | (DE) | 227/63 |
| WO 92/17320 | * | 10/1992 | (WO) | 254/28 |

* cited by examiner

*Primary Examiner*—Scott A. Smith
(74) *Attorney, Agent, or Firm*—Michael R. Gilman; Kaplan & Gilman LLP

(57) ABSTRACT

A pivotally connected stapler machine is disabled as a staple ejecting apparatus and is converted into pivotally connected lever handles to operate the enabled double jawed staple remover. To disable the stapler machine and enable the staple remover, stapler machine magazine (24), magazine shroud (56) are pushed rearward on base (10) along the hinge pin guide track (18) enabling pivotally connected staple remover jaws consisting of bottom staple remover jaw (38) and top staple remover jaw (44) to open and close concurrently with the squeezing and releasing of the pivotally connected lever handles.

19 Claims, 4 Drawing Sheets

RETRACTABLE STAPLE REMOVER JAWS UTILIZING STAPLER MACHINE AS LEVER HANDLES

CONTINUING APPLICATION

This application claims the benefit of Provisional Patent Application Ser. No. 60/111,970 filed Dec. 11, 1998.

BACKGROUND—FIELD OF THE INVENTION

This invention relates to an office desktop type double jawed staple remover tool that removes staples from compiled paper packages.

BACKGROUND—DESCRIPTION OF PRIOR ART

Offices and homes around the world use desktop staple machines for attaching multiple papers together creating compiled paper packages. The U shaped wire staples that holds these paper packages together often times have a need to be removed.

Thereafter, Inventors created several types of staple removers the most common place being are variations of the double jawed pinch type as described in U.S. Pat. Nos. 5,354,033 (1993) 4,903,945 (1990) 5,085,404 (1992) 4,944,491 (1990) 4,784,370 (1998) 4,921,216 (190) 4,674,727 (1987) 4,054,263 (1977) 3,974,999 (1976) 5,292,106 (1994) 5,284,322 (1993).

This type of staple remover has had the greatest success in the market place. However, there is one problem with this type of staple remover that anyone owning one has encountered. It is easily misplaced.

Inventors have tried to conveniently attach a staple remover to a stapler machine to overcome this problem. Whereas the combination of both entities have taken place in two ways. One way is to provide an attachment or housing means to a stapler machine as described in patents U.S. Pat. Nos. 3,672,635 (1972) and 3,563,513 (1971). In each case, the combination made the stapler machine cumbersome or awkward to the user.

The second type is a small staple removing pry bar attached to the bottom of a stapler machine as seen in Staples office supply catalogs and stores (No patent numbers available). This attached staple remover made the combination less cumbersome but still awkward. Another combination as seen in patent U.S. Pat. No. 5,184,765 (1993) provides a removable pry tool within the stapler machine.

The pry type method of removing staples is able to lift staples partially away from the paper package and the users fingers would need to complete the extraction.

Of these combinations, neither made a large improvement or impact in the staple remover market place.

All previous staple removers known suffer from a number of disadvantages:

(a) Pinch type double jawed staple removers are easily misplaced.

(b) Pinch type double jawed staple removers offer no additional leverage for removing staples that are tougher to remove from thick compiled paper packages.

(c) Pry type staple removers that are permanently attached to staple machines are awkward to use.

(d) Pry type staple removers can only remove a staple partially and needs to be fully extracted by users fingers.

(e) Pry type staple removers that are removable from stapler machine are easily lost or misplaced.

(f) Staple removers that are part of a housing attachment are cumbersome or awkward to use.

SUMMARY INCLUDING OBJECTIVES AND ADVANTAGES

The double jawed staple remover tool described herein is attached and pivots on the hinged end of stapler machine. When staple remover is enabled the stapler machine is disabled and utilizes the disabled stapler machine as lever handles providing leverage to open and close staple remover jaws.

The double jawed staple removing tool is able to easily remove staples using the stapler machine as lever handles. The movement would be similar to using a pliers type tool.

This new staple removing tool is user friendly for visual contact on a busy paper cluttered desk and offers the user a more convenient, more comfortable and more powerful staple remover.

OBJECTIVES AND ADVANTAGES

Accordingly, several objectives and advantages of this invention are:

(a) To provide a staple remover that offers the user an easy, comfortable and stronger way of removing staples using pliers type leverage.

(b) To provide a staple remover that is easy to locate on a busy office desk.

(c) To provide a staple remover that can be part of a stapler machine without making the stapler machine cumbersome or awkward to use.

(d) To provide a still easily marketable yet more efficient combination stapler machine and staple remover.

(e) To attach a proven successful staple remover to a staple machine.

Still further objectives and advantages will become apparent from a consideration of the ensuing description and accompanying drawings.

DRAWING REFERENCE NUMERALS

10 base

12 anvil

14 stapler magazine latch

16 leg and spring stop

18 hinge pin guide track

22 stapler magazine staple guide track

24 stapler machine magazine

26 spring bar latch hole

Figure 1A:
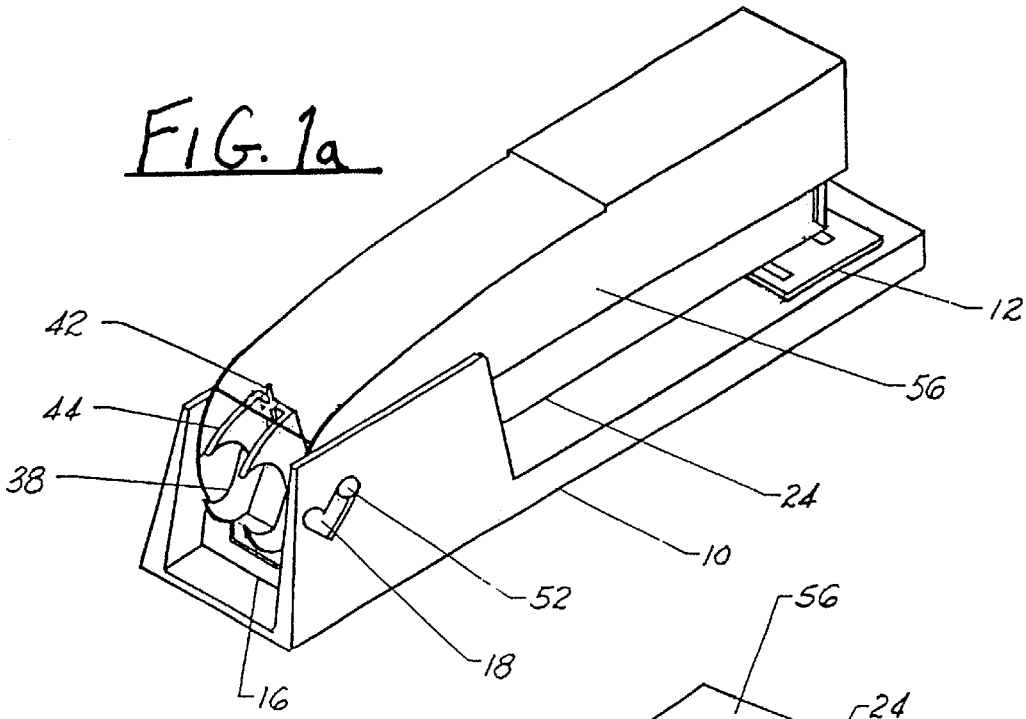
FIG. 1*a* and 1*b* shows overall perspective views of the retractable double jawed staple remover apparatus in two positions, stapler machine enabled (shown top) and staple remover enabled (shown below).

28 magazine hinge pin holes
30 spring bar guide pin
32 spring bar
34 spring bar latch
36 spring hook
38 bottom staple remover jaw
40 spring bar and bottom jaw pin holes
42 torsion spring for top and bottom jaws
44 top staple remover jaw
46 top jaw legs
48 top jaw pin holes
50 lever handle torsion spring
52 hinge pin
54 torsion spring eyes
56 magazine shroud
58 spring bar spring
60 drive plate and spring bar guide
62 stapler magazine shroud pin holes
64 stapler magazine stop
65 staple push plate spring
66 staple push plate
67 magazine base guide

EMBODIMENT—DESCRIPTION

As shown in FIGS. 1*a* and 1*b*, FIG. 2, FIG. 3 and FIG. 4 embodiments; base 10, anvil 12, stapler magazine latch 14, stapler magazine staple guide track 22, stapler machine magazine 24, spring bar latch hole 26, spring bar guide 30, spring bar latch 34, spring bar 32, spring hook 36, hinge pin 52, magazine shroud 56, spring bar spring 58, drive plate and spring bar guide 60, staple push plate spring 65, staple push plate 66, magazine base guide 67 are used for operation of a stapler machine. Whereas this application is not submitted for a staple machine, all embodiments of a staple machine are labeled for two reasons:

First, so it is understood that the stapler machine will be fully functional with the retractable staple remover jaws attached.

Second, so that these embodiments can be referred to as necessary either now or in the future because the same embodiments are converted to lever handles for operating the double jawed staple remover when enabled. However, for less confusion, only base 10, stapler magazine 24-magazine shroud 56 will usually be referred to in this application as lever handles for operating double jawed staple remover. Base 10 being one half of the lever handles providing operating leverage for one half of the staple remover jaws. As mentioned above representing embodiments for other half of lever handles are magazine 24-shroud 56 providing operating leverage to operate the other half of staple remover jaws. Both lever handles pivot on hinge pin 52 that provides a leverage fulcrum point for criss X cross effect in operating top staple remover jaw 44 and bottom staple remover jaw 38.

Figure 1B:
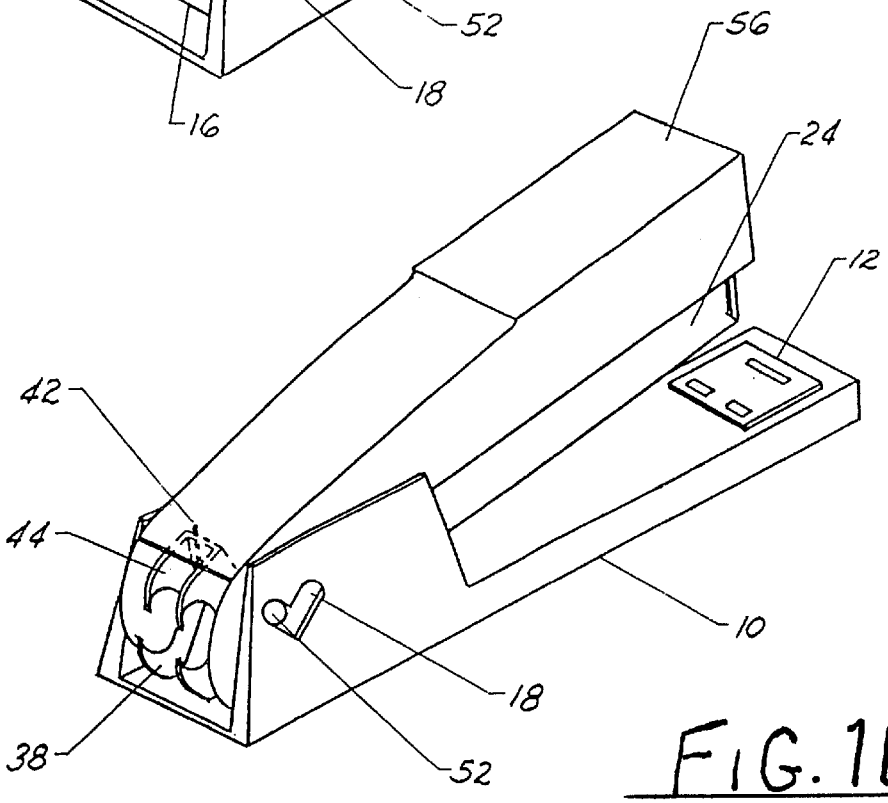

As shown in FIG. 1*a* the apparatus as shown in top view is used as a standard stapler machine. As shown in FIG. 1*b* the staple remover is enabled by pushing the stapler machine magazine 24-magazine shroud 56 rearward on the base 10 to expose and enable the top staple remover jaw 44 and bottom staple remover jaw 38 at the rear of the stapler machine. The movement rearward of magazine 24-shroud 56 is possible by sliding the hinge pin 52 along the hinge pin guide track 18 until the hinge pin 52 is in the staple remover mode seat at the end of guide track 18.

Figure 3:
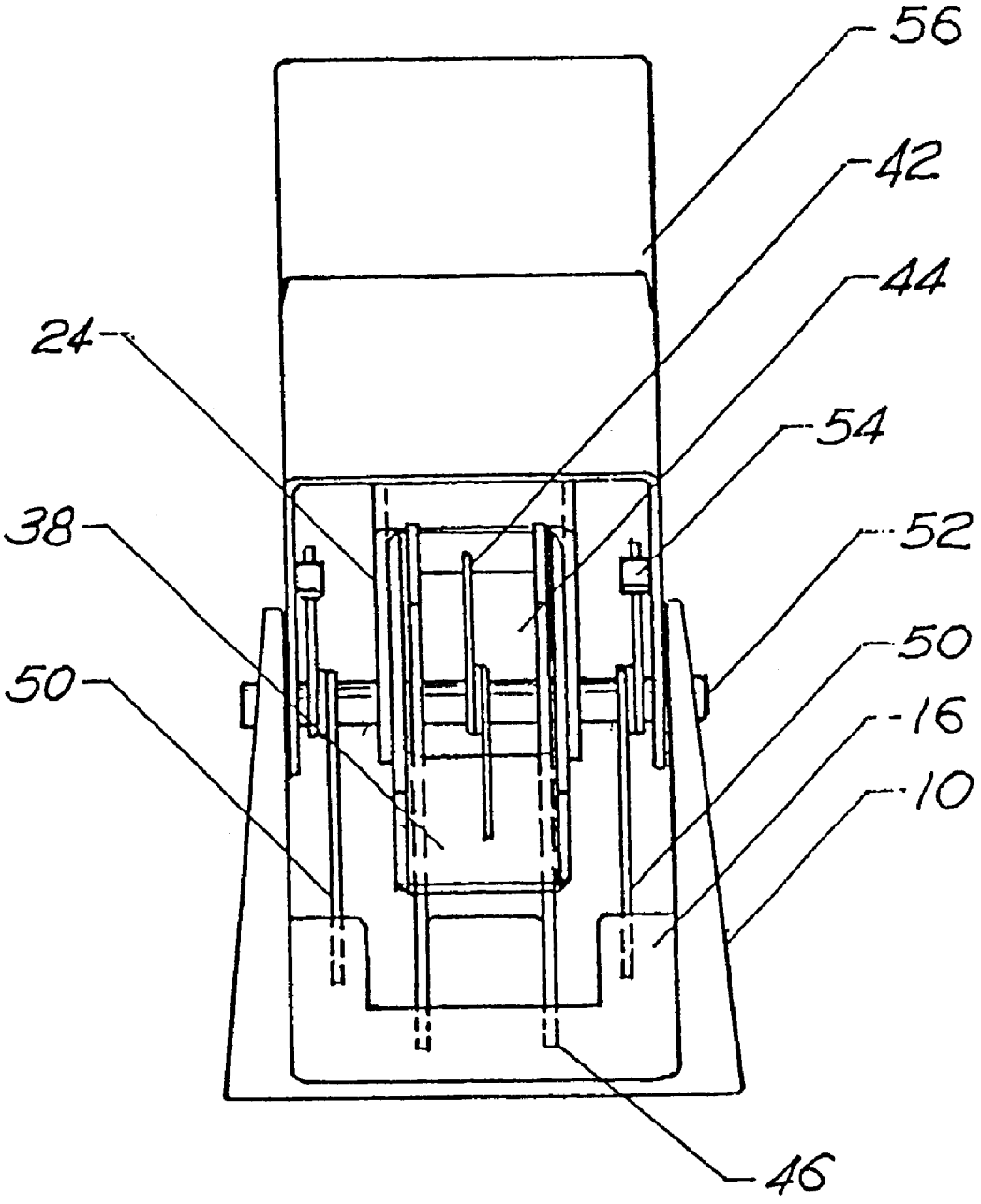
FIG. 3 is a rear end view (hinge side) of stapler machine where the retractable double jawed staple remover resides.
Figure 4:
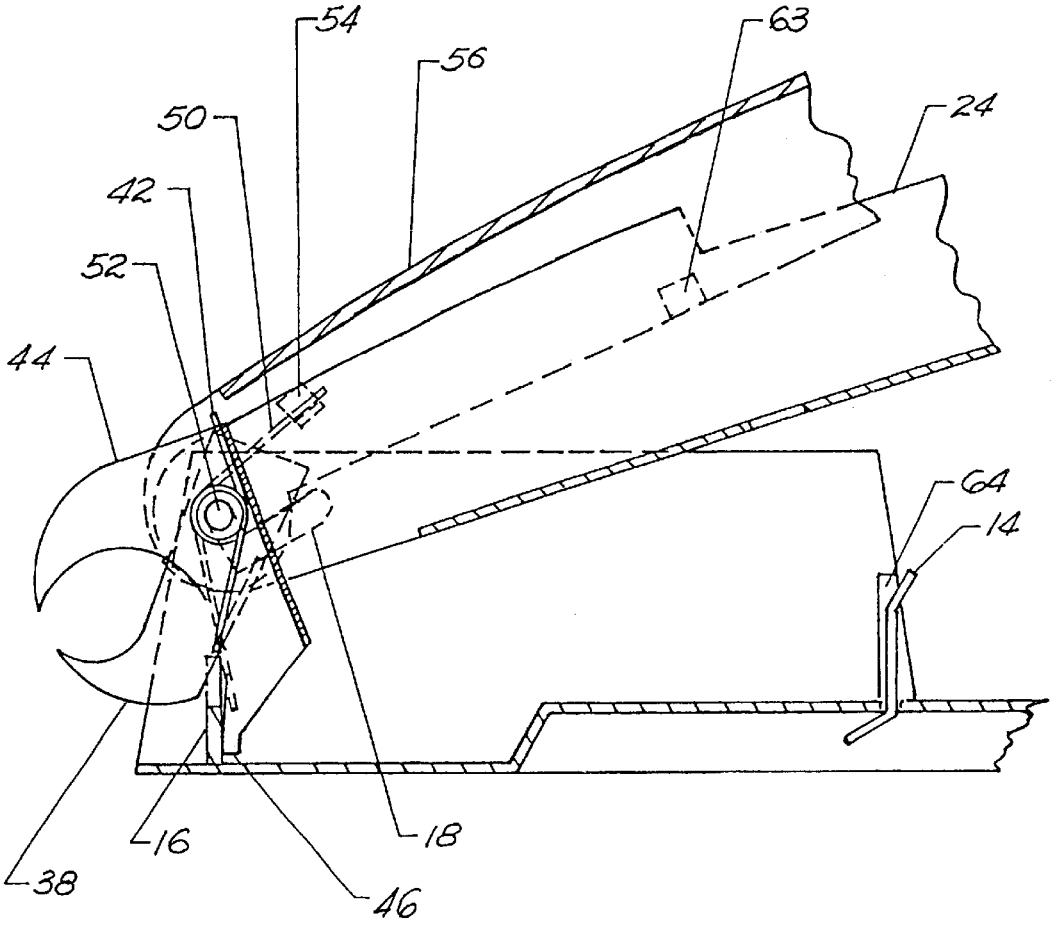
FIG. 4 is a detailed enlarged cross section view taken at center of enabled retractable double jawed staple remover.

As shown in FIG. 3/4 and FIG. 3 and FIG. 4 the operating embodiments; base 10, top jaw legs 46, lever handle torsion spring 50, hinge pin 52, top staple remover jaw 44, torsion spring for top and bottom jaws 42, stapler machine magazine 24, magazine shroud 56, spring bar 32, bottom staple remover jaw 38 actively work to open and close staple remover jaws.

Figure 2:
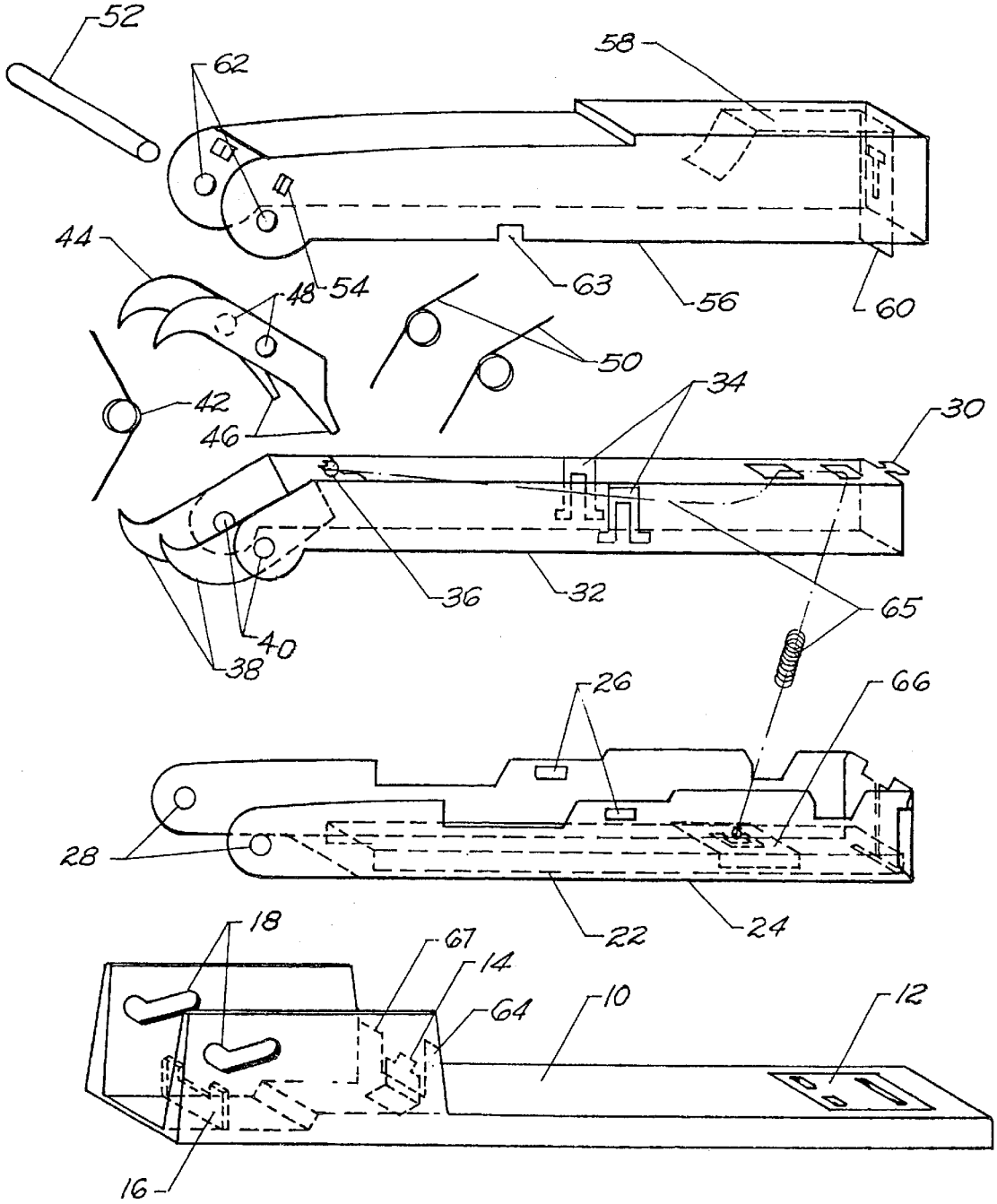
FIG. 2 is a detailed exploded view of the retractable double jawed staple remover embodiments as well as stapler machine embodiments in their perspective views.

As shown in FIG. 2 and FIG. 4 stationary embodiments that also are needed for this invention are: hinge pin guide track 18, leg and spring stop 16, torsion spring eyes 54, stapler machine stop release notch 63, stapler magazine stop 64, stapler magazine shroud pin holes 62,magazine hinge pin holes 28, top jaw pin holes 48, spring bar and bottom jaw pin holes 40. These stationary embodiments anchor the active embodiments of the double jawed staple remover and disable or enable the stapler machine.

As shown in FIG. 4 top staple remover jaw 44 and bottom staple remover jaw 38 are operable to open and close by squeezing and releasing magazine 24-shroud 56, and base 10. The movement is similar to how a user would squeeze and release a pair of spring loaded pliers.

Also as shown in FIG. 4 the stapler machine magazine 24 will not be able to eject any staples when the staple remover is enabled. As indicated the magazine shroud 56 is stopped on contact of stapler magazine stop 64 prior to being able to eject staples. When the stapler machine is enabled again the stapler magazine stop release notch 63 bypasses the stapler magazine stop 64 and allows the stapler machine magazine 24 to release staples.

EMBODIMENT—OPERATION

The open and close movement of the double jawed staple remover when enabled happens when the user of staple machine that houses the double jawed staple remover converts the operating embodiments of the stapler machine. These converted embodiments; base 10, stapler magazine 24-magazine shroud 56 are used as lever handles providing leverage to operate the jaws of the staple remover.

As shown in FIG. 1*a* a standard type stapler machine similar to Swingline model 767 (no patent numbers available) shows bottom staple remover jaw 38 and top staple remover jaw 44 residing obscured inside the rear of enabled stapler machine.

To disable the staple machine the user slides hinge pin 52 with the pivotally connected stapler magazine 24-magazine shroud 56 along the hinge pin guide track 18 to rear of base 10, concurrently as shown in FIG. 1*b* and FIG. 4 the double jawed staple remover is enabled.

As shown in FIG. 4 once the stapler machine magazine 24-magazine shroud 56 are engaged on hinge pin guide track 18 to rear of base 10, the pivotally connected top jaw legs 46 makes contact with leg and spring stop 16. The movement upward of base 10 created by squeezing magazine 24-shroud 56 and base 10 together pushes leg and spring stop 16 to move top jaw legs 46 upward. The movement upward of leg 46 pivots extraction end of top staple remover jaw 44 downward toward extraction end of bottom staple remover jaw 38.

The bottom staple remover jaw 38 as shown in FIG. 2 is permanently attached to the spring bar 32 so it can pivot concurrently on hinge pin 52. One half of the lever handles, stapler machine magazine 24-magazine shroud 56 conceals spring bar 32 and incorporates spring bar 32 as part of the operating lever. This concealed connection becomes the leverage for pivoting extraction end of bottom staple remover jaw 38 upward toward extraction end of top staple remover jaw 44 when the lever handles are being squeezed.

So that the user of the double jawed staple remover needs only one hand to operate the apparatus, lever handle torsion springs 50 are used to repel the lever handles (base 10 away from stapler machine magazine 24-magazine shroud 56). Torsion spring for top and bottom staple remover jaws 42 are used to push extraction end of bottom staple remover jaw 38 and top staple remover jaw 44 away from each other. This spring action combination enables the user to need one movement in squeezing the lever handles together. When releasing the squeezing movement the jaws of the staple remover are reopened. As shown in FIG. 4 bottom jaw 38 and top jaw 44 are in open position and magazine 24-shroud 56 and base 10 are enabled to extract staples prior to squeezing movement.

The lever handle torsion springs 50 are attached to magazine shroud 56 by torsion spring eyes 54 and threaded at center on hinge pin 52 as shown in FIG. 3. The lever handle torsion springs 50 becomes active and creates tension when stapler machine magazine 24-magazine shroud 56 are pushed rearward on base 10 along the hinge pin guide track 18. This movement enables lever handle torsion springs 50 to sit against leg and spring stop 16 where the high ends of the leg and spring stop 16 pushes on unconnected end of lever handle torsion spring 50. This contact creates tension on the torsion springs 50 and provides resistance for the double jawed staple remover lever handles.

All pivoting components as shown in FIG. 3 and FIG. 4 for stapler machine as well as staple remover share the same hinge pin 52. The hinge pin 52 is threaded through hinge pin guide track 18, magazine hinge pin holes 28, spring bar and bottom jaw pin holes 40, top jaw pin holes 48, lever handle torsion springs 50, torsion spring for top and bottom jaws 42, stapler magazine shroud pin holes 62.

Once staple remover is enabled, the stapler machine will become disabled and unable to eject staples. The disabling of the stapler machine happens when magazine shroud 56 makes contact with stapler magazine stop 64 as indicated in FIG. 4. The stapler magazine stop release notch 63 will bypass the stop 64 for the stapler machine to function again after the stapler machine magazine 24-magazine shroud 56 are push forward on base 10 enabling the stapler machine.

CONCLUSIONS, RAMIFICATIONS AND SCOPE

Accordingly, it can be seen that the double jawed staple removing tool is an inexpensive, innovative and convenient way of combining two apparatuses by using embodiments of one apparatus to provide operating means for the other. As shown in this application the stapler machine is rendered disabled and becomes the operating lever handles that open and close jaws of the retractable double jawed staple remover.

Although the description above contains many specificities, these should not be construed as limiting the scope of the invention but as merely providing illustrations of some of the presently preferred embodiments of this invention. Various other embodiments and ramifications are possible within its scope. For example, the stapler machine when acting as lever handles can operate other type of tools that are jawed such as: Hole Punch, Pliers, etc.

Thus the scope of the invention should be determined by the appended claims and their legal equivalents, rather than by the examples given.

What is claimed is:

1. A combination stapling machine and tool, comprising:

a stapler, comprising:

a base lever;

a staple driving lever, for driving a staple onto said base lever; and a pin, around which said staple driving lever and said base lever pivot when said staple driving lever is driving said staple onto said base lever; and a double jawed tool, comprising first and second jaws, wherein both of said first and second jaws pivot around said pin of said stapler;

wherein said pin is selectively slidable between a first staple driving position and a second double jawed tool working position, with said stapler only operable when said pin is in said first position, and with said double jawed tool only operable when said pin is in said second position.

2. A combination stapling machine and tool as recited in claim 1, wherein said staple is driven onto said base lever proximate a first end of said combination stapling machine and tool, and said pin is located proximate a second, opposite end of said combination stapling machine and tool.

3. A combination stapling machine and tool as recited in claim 2, further comprising a housing, wherein said double jawed tool is concealed within said housing, at said second end of said combination stapling machine and doubled jawed tool when said pin is in said first position.

4. A combination stapling machine and tool as recited in claim 1, further comprising a latch located and operable between said base lever and said staple driving lever, said latch having a latched and a released state, wherein said stapler is operable when said latch is in said latched state, and said pin is selectively slidable from said first position to said second position when said latch is in said released state.

5. A combination stapling machine and tool as recited in claim 1, said double jawed tool further comprising at least one spring for biasing said first and second jaws to their open state, when said pin is in said second position so as to allow for single handed use of said combination stapling machine and tool by a user.

6. A combination stapling machine and tool as recited in claim 1, wherein said double jawed tool operates when said staple driving lever and said base lever pivot around said pin in a direction toward each other.

7. A combination stapling machine and tool as recited in claim 6, said base lever having a stop attached thereto, located below said pin, and said first jaw of said double jawed tool having an active end and an inactive end, said active end interacts with said second jaw of said double jawed tool when said double jawed tool operates, and said inactive end interacts with said stop when said double jawed tool operates.

8. A combination stapling machine and tool as recited in claim 7, wherein said interaction of said inactive end and said stop causes said active end to interact with said second jaw when said staple driving lever and said base lever pivot around said pin in a direction toward each other.

9. A combination stapling machine and tool as recited in claim 1, wherein said double jawed tool is a staple remover.

10. A combination stapling machine and tool, comprising:

a stapler, comprising:

a base lever;

a staple driving lever, for driving a staple onto said base lever; and a pin, around which said staple driving lever and said base lever pivot when said staple driving lever is driving said staple onto said base lever; and a double jawed tool, comprising first and second jaws, said first and second jaws movable between an open and a closed state, wherein said double jawed tool is capable of performing certain functions when said first and second jaws move from said open state to said closed state, and further wherein said first and second jaws move from said open state to said closed state when said staple driving lever and said base lever pivot around said pin in a direction toward each other;

wherein said pin is selectively slidable between a first staple driving position and a second double jawed tool working position, with said stapler only operable when said pin is in said first position, and with said double jawed tool only operable when said pin is in said second position.

11. A combination stapling machine and tool as recited in claim 10, wherein said movability of said first and second jaws is a pivoting around said pin of said stapler.

12. A combination stapling machine and tool as recited in claim 11, said pin having a first staple driving position and a second double jawed tool working position.

13. A combination stapling machine and tool as recited in claim 12, wherein said pin is selectively slidable between said first and second positions.

14. A combination stapling machine and tool as recited in claim 10, further comprising a latch located and operable between said base lever and said staple driving lever, said latch having a latched and a released state, wherein said double jawed tool is operable when said latch is in said released state, and said double jawed tool is inoperable when said latch is in said latched state.

15. A combination stapling machine and tool as recited in claim 10, said double jawed tool further comprising at least one spring for biasing said first and second jaws to their open state, when said pin is in said second position so as to allow for single handed use of said combination stapling machine and tool by a user.

16. A combination stapling machine and tool as recited in claim 10, further comprising first and second ends, said staple being driven onto said base lever proximate said first end of said combination stapling machine and tool, and said pin being located proximate said second end of said combination stapling machine and tool, and a housing located at said second end of said combination stapling machine and tool, wherein said double jawed tool is concealed within said housing, at said second end of said combination stapling machine and doubled jawed tool when said pin is in said first position.

17. A combination stapling machine and tool as recited in claim 10, said base lever having a stop attached thereto, located below said pin, and said first jaw of said double jawed tool having an active end and an inactive end, said active end interacts with said second jaw of said double jawed tool when said double jawed tool operates, and said inactive end interacts with said stop when said double jawed tool operates.

18. A combination stapling machine and tool as recited in claim 17, wherein said interaction of said inactive end and said stop causes said active end to interact with said second jaw when said staple driving lever and said base lever pivot around said pin in a direction toward each other.

19. A combination stapling machine and tool as recited in claim 10, wherein said double jawed tool is a staple remover.

* * * * *